US005341767A

United States Patent [19]

Smith

[11] Patent Number: 5,341,767

[45] Date of Patent: Aug. 30, 1994

[54] COMBUSTION AIR INLET DIVERTER PLATE FOR A WATER HEATER

[75] Inventor: Herbert E. Smith, Sumter, S.C.

[73] Assignee: AOS Holding Company, Milwaukee, Wis.

[21] Appl. No.: 57,725

[22] Filed: May 5, 1993

[51] Int. Cl.[5] ..... F24H 1/00

[52] U.S. Cl. ..... 122/14; 126/312; 454/259; 454/275

[58] Field of Search ..... 122/13.1, 511, 14, 18; 454/254, 259, 275, 276, 283; 126/307, 312

[56] References Cited

U.S. PATENT DOCUMENTS

| | | | |
|---|---|---|---|
| 532,452 | 1/1895 | Elwell | 454/254 |
| 983,179 | 1/1911 | Swift | 454/254 |
| 3,112,687 | 12/1963 | Henneberger | 98/37 |
| 3,279,349 | 10/1966 | Landau | 98/30 |
| 3,435,816 | 4/1969 | De Werth | 126/85 |
| 3,477,358 | 11/1969 | Howard | 98/64 |
| 3,521,582 | 7/1970 | Liden | 110/147 |
| 4,262,608 | 4/1981 | Jackson | 110/162 |
| 4,286,569 | 9/1981 | Bergman | 126/85 |
| 4,690,129 | 9/1987 | Halstead | 126/85 |
| 4,925,093 | 5/1990 | Moore, Jr. | 237/19 |
| 4,938,123 | 7/1990 | Hilton | 454/254 |
| 4,940,042 | 7/1990 | Moore et al. | 126/344 |
| 5,199,385 | 4/1993 | Doss | 122/504 |

FOREIGN PATENT DOCUMENTS

| | | | |
|---|---|---|---|
| 3816869 | 11/1989 | Fed. Rep. of Germany | 454/254 |

*Primary Examiner*—Henry A. Bennet
*Assistant Examiner*—William C. Doerrler
*Attorney, Agent, or Firm*—David R. Price; James Earl Lowe, Jr.

[57] ABSTRACT

A water heater comprising a tank defining a water chamber, a combustion chamber for heating water in the water chamber, and a combustion air inlet pipe including an outlet end communicating with the combustion chamber. The inlet pipe also includes an inlet end having a longitudinal axis, and a plate in the combustion air inlet pipe adjacent the inlet end, which plate extends outwardly of the inlet end along the longitudinal axis.

8 Claims, 1 Drawing Sheet

COMBUSTION AIR INLET DIVERTER PLATE FOR A WATER HEATER

BACKGROUND OF THE INVENTION

The invention relates to water heaters, and more particularly to water heaters having a combustion chamber and an air inlet pipe communicating with the combustion chamber.

It is known to provide an air scoop at the inlet end of an air inlet pipe to direct air into the inlet pipe. It is also known to provide a directionally adjustable ventilated cover at the inlet end to prevent the introduction of water or other unwanted debris into the inlet pipe.

SUMMARY OF THE INVENTION

The invention provides a water heater including a water chamber and a combustion chamber for heating water in the water chamber. An air inlet pipe supplies air to the combustion chamber. The inlet pipe includes an outlet end communicating with the combustion chamber, and an inlet end located outside the building in which the water heater is located.

The water heater also includes a diverter plate in the inlet end of the pipe. The plate preferably is planar and vertical. The plate also preferably extends a short distance into the pipe and divides the pipe into two longitudinally extending portions adjacent the inlet end. The plate generally extends along the longitudinal axis of the inlet end. The plate also has a semicircular portion extending out of the inlet end. A hemispherical screen covers the inlet end of the pipe and the semicircular portion of the diverter plate.

A principal advantage of the invention is the provision of a water heater having an air inlet pipe diverter plate as described above. If wind blows over the inlet end, the diverter plate substantially prevents the creation of a vacuum or negative pressure that could prevent the flow of fresh air to the combustion chamber.

Other features and advantages of the invention will become apparent to those skilled in the art upon review of the following detailed description, claims, and drawings.

Figure 1:
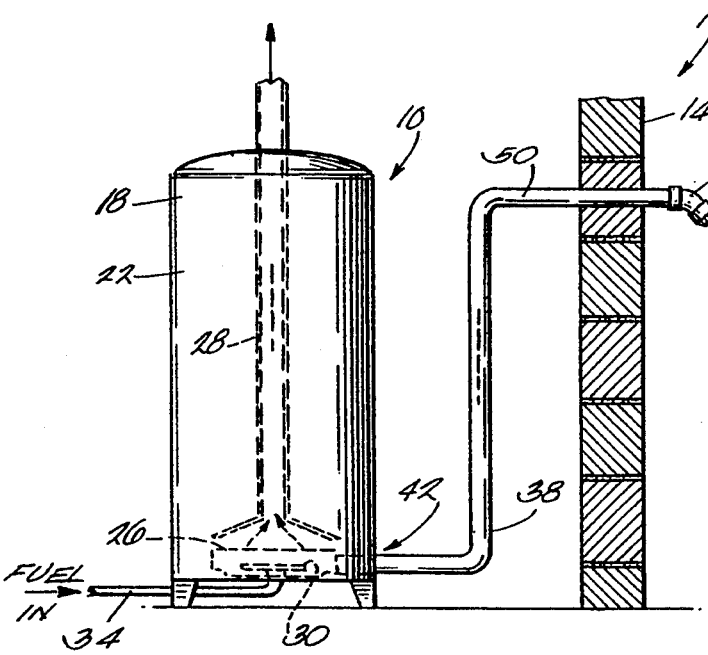
FIG. 1 is a side elevational view of a water heater embodying the invention and including a combustion air inlet pipe assembly.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

FIG. 1 of the drawings shows a water heater 10 adjacent an outside wall 14 of a structure 16 within which the water heater 10 is housed. The water heater 10 includes a tank 18 defining a water chamber 22. The water heater 10 also includes a combustion chamber 26 beneath the water chamber 22. A flue 28 extends upwardly from the combustion chamber 26 and through the water chamber 22. The water heater 10 also includes a burner 30 in the combustion chamber 26 and a fuel supply conduit 34 connected to the burner 30. The flue 28 exhausts the combustion byproducts from the combustion chamber 26 to a chimney or vent (not shown).

The water heater 10 also includes a combustion air inlet pipe 38 supplying air to the combustion chamber 26 to allow the fuel to burn. The inlet pipe 38 is preferably made of poly vinyl chloride and has an outlet end 42 communicating with the combustion chamber 26 and an inlet end 46 located outside the building 16.

Figure 2:
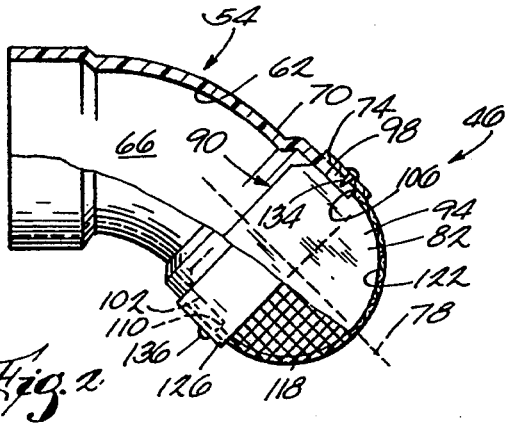
FIG. 2 is an enlarged side elevational view, partially in section, of the inlet end portion of the pipe assembly.

The pipe 38 preferably includes a main conduit 50 extending from the combustion chamber 26 to the outside of the building 16. The pipe 38 also includes an elbow fitting 54 which is connected to the main conduit 50 and which has a 45° elbow joint. The elbow fitting 54 defines the inlet end 46 of the pipe 38 and, as shown in FIG. 2, has an inner surface 62 defining a passage 66 and an outer surface 70 defining an outer border 74 adjacent the inlet end 46. The fitting 54 is connected to the main conduit 50 so that the inlet end 46 opens downwardly at a 45° angle with respect to horizontal. The inlet end 46 has a longitudinal axis 78.

Figure 4:
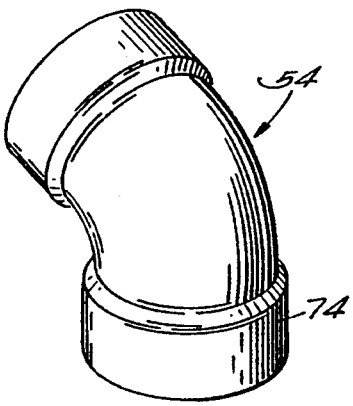
FIG. 4 is an exploded view of the inlet end of the pipe assembly.
Figure 4:
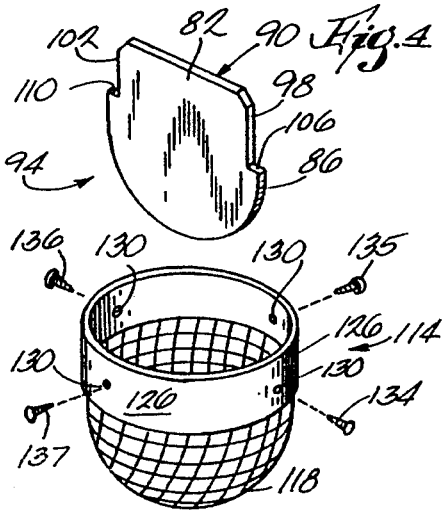
Figure 3:
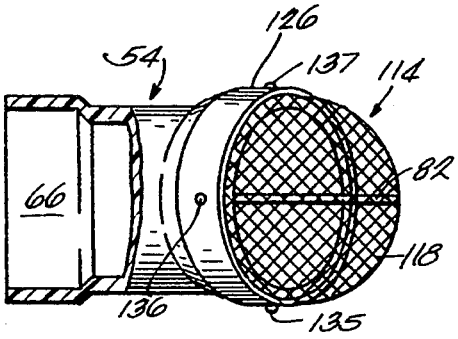
FIG. 3 is a bottom plan view of the inlet end portion of the pipe assembly with portions cut away.

The water heater 10 also includes a generally planar diverter plate 82 in the elbow fitting 54. The plate 82 is vertically oriented, extends along the axis 78, and divides the fitting passage 66 into two longitudinally extending portions adjacent the inlet end 46. In the preferred embodiment of the invention, the diverter plate 82 (best shown in FIG. 4) has a continuous side edge 86 defining a rectangular inner portion 90 and a semi-circular outer portion 94. The inner portion 90 includes spaced side edge segments 98 and 102 parallel to the longitudinal axis 78. The side edge segments 98 and 102 frictionally engage the inner surface 62 of the fitting 54. The continuous side edge 86 also includes a pair of oppositely disposed shoulders 106 and 110 connecting the side edge segments 98 and 102 to the semi-circular outer portion 94. The shoulders 106 and 110 are perpendicular to the longitudinal axis 78 and abut the end of the fitting 54 to prevent the diverter plate 82 from moving into the inlet pipe 38.

The inlet pipe 38 also includes a screen assembly 114 covering the inlet end 46. The assembly 114 (best shown in FIGS. 2 and 4) includes a hemispherical screen 118. The screen 118 has an inner surface 122 (FIG. 2) which is complementary with, and which may be in contact with, the outer portion 94 of the plate 82. The screen assembly 114 also includes a collar 126 which fits over the outer border 74 of the fitting 54. The screen 118 is soldered to the collar 126. The collar 126 has (see FIG. 4) four through bores 130 evenly spaced around the collar 126. Four self-tapping screws 134, 135, 136, and 137, are threaded into respective bores 30 and into the outer border 74 of the fitting 54 to secure the screen assembly 114 to the fitting 54. As shown in FIG. 2, two diametrically opposed screws 134 and 136 engage respective side edge segments 98 and 102 of the plate 82 to secure the plate 82 relative to the fitting 54.

As wind blows over the inlet end 46 of the combustion air inlet pipe 38, the plate 82 substantially prevents horizontal air flow completely across the inlet end 46 and thereby prevents the creation of a vacuum or negative pressure which could extinguish combustion in the combustion chamber 26.

In an alternative embodiment (not shown), the diverter plate 82 is mounted to the inlet end 46 of the inlet pipe 38 but does not extend into the inlet pipe 38. Instead, the plate 82 has an inner edge in the plane defined by the inlet end 46 of the inlet pipe 38. In other words, the plate 82 extends only outwardly of the inlet end 46 of the pipe 38.

Various features of the invention are set forth in the following claims.

I claim:

1. A water heater comprising:

a tank defining a water chamber;

a combustion chamber for heating water in said water chamber, a combustion air inlet pipe including an outlet end communicating with said combustion chamber, and including a generally horizontal inlet pipe; and a generally planar vertical plate connected to said inlet end of said pipe, said plate extending outwardly from and extending across said inlet end so as to substantially prevent horizontal air flow completely across said inlet end.

2. A water heater as set forth in claim 1 wherein said plate extends into said pipe and divides said inlet pipe into two longitudinally extending portions adjacent said inlet end.

3. A water heater as set forth in claim 2 wherein said plate includes a semi-circular portion extending outwardly of said inlet end.

4. A water heater as set forth in claim 3 wherein said inlet pipe includes a hemispherical screen covering said inlet end and said plate, and wherein said screen is complementary with said semi-circular portion.

5. A water heater as set forth in claim 4 and further comprising a cylindrical collar connecting said screen to said inlet end.

6. A water heater as set forth in claim 1 wherein said inlet pipe comprises a main conduit, and wherein said inlet end is defined by a downwardly extending elbow portion connected to said conduit.

7. A water heater as set forth in claim 6 wherein said elbow portion extends downwardly at a 45° angle with respect to horizontal.

8. A water heater as set forth in claim 1 wherein said inlet end has a longitudinal axis, and wherein said plate extends along said axis.

* * * * *